United States Patent [19]

Deve

[11] 3,966,174

[45] June 29, 1976

[54] PREMIX NOZZLE FOR KOLD BOX PROCESS

[75] Inventor: Vagn Deve, Shaker Heights, Ohio

[73] Assignee: Combustion Engineering, Inc., Windsor, Conn.

[22] Filed: Feb. 2, 1973

[21] Appl. No.: 329,007

[52] U.S. Cl. ..... 259/4 R; 164/158; 222/148; 259/18

[51] Int. Cl.[2] ..... B22C 15/24; B01F 15/02

[58] Field of Search ..... 259/4, 18, 36, 9, 51, 259/52, 61, 79, 94, 35, 68, 70, 109, 150, 180; 164/37, 43, 154, 21, 158; 222/141, 148, 145; 99/289

[56] References Cited

UNITED STATES PATENTS

| | | | |
|---|---|---|---|
| 2,593,425 | 4/1952 | Evans | 259/180 |
| 2,978,974 | 4/1961 | Rockriver | 99/289 |
| 2,991,049 | 7/1961 | Clarke et al. | 259/4 |
| 3,179,990 | 4/1965 | Freeman | 164/43 X |
| 3,255,500 | 6/1966 | Engel et al. | 164/43 |
| 3,376,023 | 4/1968 | Lage | 259/4 |
| 3,472,307 | 10/1969 | Godding | 164/37 |
| 3,494,412 | 2/1970 | Abraham | 164/154 |
| 3,532,326 | 10/1970 | Schillinger et al. | 259/18 |
| 3,590,906 | 7/1971 | Bayliss | 164/43 |
| 3,603,567 | 9/1971 | Sackett, Sr. | 259/180 |
| 3,662,812 | 5/1972 | Godding | 259/18 X |
| 3,822,734 | 7/1974 | Edwards | 259/8 X |

FOREIGN PATENTS OR APPLICATIONS

| | | | |
|---|---|---|---|
| 1,915,808 | 3/1970 | Germany | 164/43 |
| 1,958,279 | 8/1970 | Germany | 164/43 |

*Primary Examiner*—Billy J. Wilhite
*Assistant Examiner*—James A. Niegowski
*Attorney, Agent, or Firm*—Stephen L. Borst

[57] ABSTRACT

A foundry mold or core blowing premix nozzle for use in connection with the kold core process. The nozzle contains a mixing chamber that allows thorough mixing to occur during the blowing process. Immediately after the blowing operation the nozzle may be cleaned of any residual sand/catalyst/resin mixture which would ordinarily set up and clog the nozzle if allowed to remain within the nozzle. This cleaning feature is provided by a push through shuttle that sweeps the mixing chamber and moves a turbulence inducing baffle, normally positioned within the chamber, to a position external to the nozzle where it may readily be cleaned.

9 Claims, 5 Drawing Figures

PREMIX NOZZLE FOR KOLD BOX PROCESS

BACKGROUND OF THE INVENTION

1. Field of the Invention

This invention relates generally to foundry mold and core blowing machines incorporating a sand/resin mixture. More particularly this invention relates to the mixing chamber or nozzle of such a blowing machine.

2. Description of the Prior Art

In the foundry art, cores or molds are made from mixtures of aggregate materials, ordinarily sand, which have been combined with polymerizable or curable material. After the sand and binder have been mixed, the resulting sand/binder mix is rammed, blown or otherwise introduced into a pattern, thereby causing it to assume the shape defined by the adjacent surfaces of the pattern. Polymerization or curing is induced by one means or another (catalyst, heat, etc.) thereby converting the formed, uncured, plastic, foundry sand mix into a hard, solid, cured state.

In recent years an increasing demand for dimensionally accurate cores has been felt by the foundry industry. Another pressure felt by the industry is the ever present need to reduce the core or mold cure time to a minimum. One way to reduce the machine cycle time and thereby increase production is to reduce the curing time of the curable resin.

In response to this need, the foundry industry has developed machines, processes and resin/catalyst mixtures that allow increasingly rapid cure and correspondingly short machine recycle time. See U.S. Pat. Nos. 3,255,500; 3,494,412 and 3,472,307, which patents are illustrative of the prior art techniques.

One of the methods developed in the prior art is the process of mixing a resin and a catalyst which react rapidly without heat, called the kold box process. The resin and catalyst are independently mixed with two separate charges of sand and then brought together and mixed only at the last minute before blowing the sand-/resin/catalyst mixture into the core box. In practice, the sand/resin/catalyst mixture is delivered, after mixing, to a second chamber which is closed off and pressurized to blow the sand into the core box. After a short period at room temperature, the cured core may be removed from the box. Reasonable results in both the areas of dimensional accuracy and minimum recycle time have become possible with improved binders.

A major difficulty that has been encountered in the prior art is that any residual sand/catalyst/resin mixture remaining anywhere in the mixing and blowing chambers of the blow machine cure just as rapidly as the blown core or mold. Once cured, these sand/resin/-catalyst residues adhere to the surfaces of the machine and tend to impede the passage of subsequent charges of sand through the machine thereby preventing its proper operation. In addition, if the volume of the charges of the originally prepared sand/resin/catalyst mixture are greater than the volume of the core to be blown, a small amount of overflow remains in the blow nozzle, necessitating swinging the machine aside and cleaning the nozzle before the short time period required for the resin to cure. A final difficulty in the prior art blowing machines arises if, for some reason, the blow operation is interrupted after the sand/resin/-catalyst mixture has been mixed and delivered to the blow chamber but before actual blowing into the core box. This mixed charge must be immediately removed and discarded or the mixture will cure within the blow chamber rendering the blow machine inoperable.

One attempted solution to the above-mentioned problems has been to premeasure the sand charges so that there is no excess sand after the blow of the core. This attempted solution has proved unsatisfactory since the measurement process is subject to error and also increases the machine cycle time. If the prepared charge is short, the core fails and the entire charge of sand must be discarded.

SUMMARY OF THE INVENTION

The present invention is directed to the mixing chamber or nozzle of a core or mold blowing machine. Sand mixed with resin and sand mixed with catalyst are introduced into the mixing chamber in alternating streams by alternating ducts. Within the mixing chamber is positioned a baffle that induces turbulence and mixing in the flow of the sand in its passage through the chamber. An alternative arrangement is provided where the sand introduced into the chamber has been previously mixed with either resin or catalyst. The other element, i.e., the resin or catalyst not mixed with the sand, is independently introduced into the chamber in predetermined amounts, in close mixing relation with the sand so that adequate mixing occurs.

In either arrangement, after mixing, the sand/resin/-catalyst is delivered into the core or mold box through an exit opening. Any remaining sand/resin/catalyst residue is immediately swept from the nozzle or mixing chamber by a movable sweep or plunger which has the same cross section as the chamber. The movement of the plunger causes the turbulence inducing baffle to be carried outside of the nozzle where it may be flushed or cleaned of any and all sand/resin/catalyst particles adhering thereto.

DESCRIPTION OF THE PREFERRED EMBODIMENT

Figure 1:
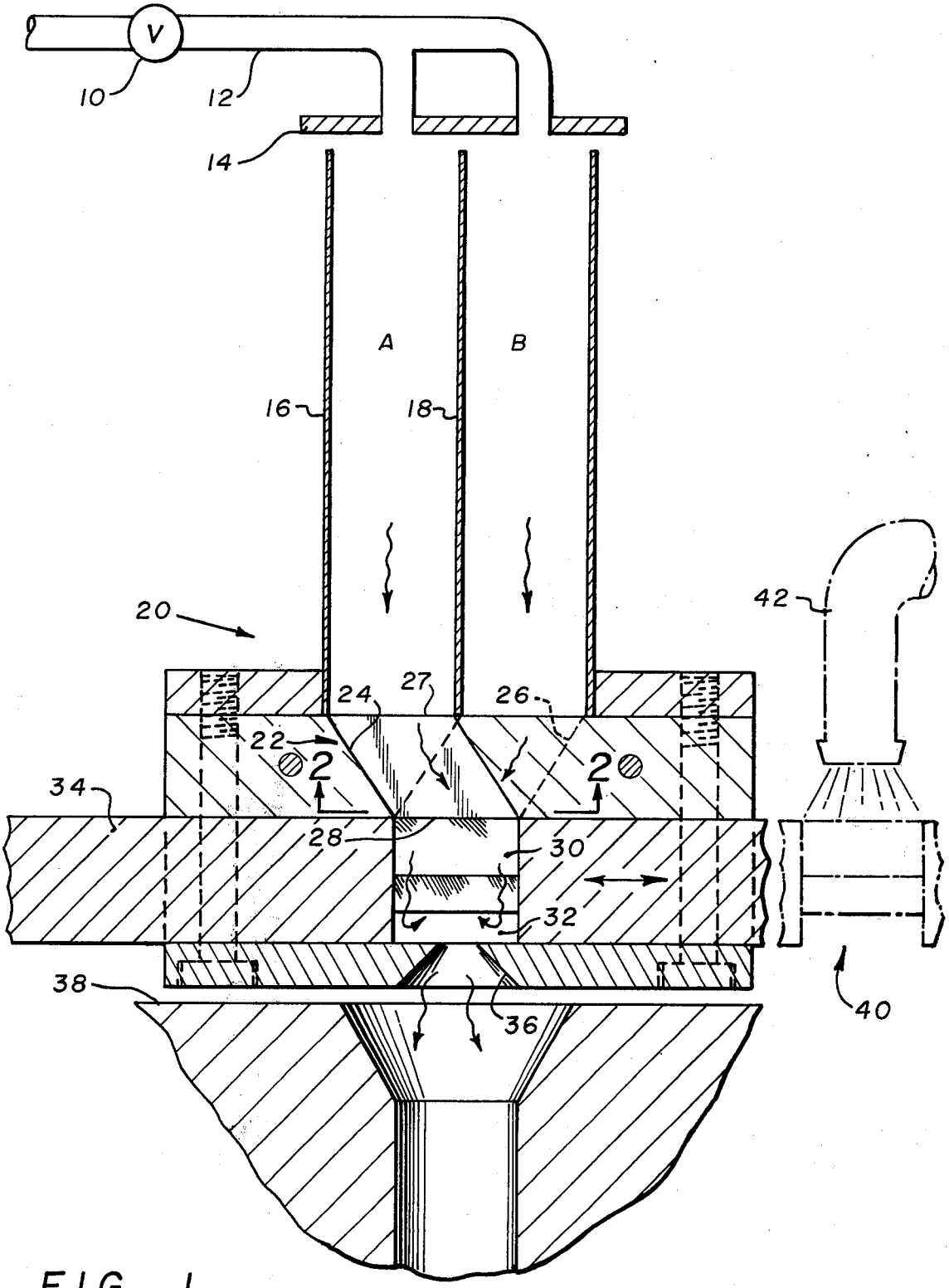
FIG. 1 is a drawing of a kold box core making machine.
Figure 2:
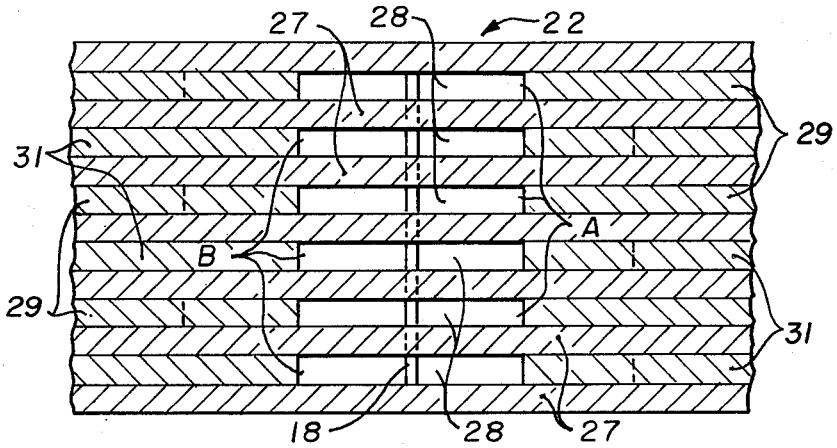
FIG. 2 is a plan view of the alternating inlet ductwork of FIG. 1 taken along sight lines 2—2.
Figure 4:
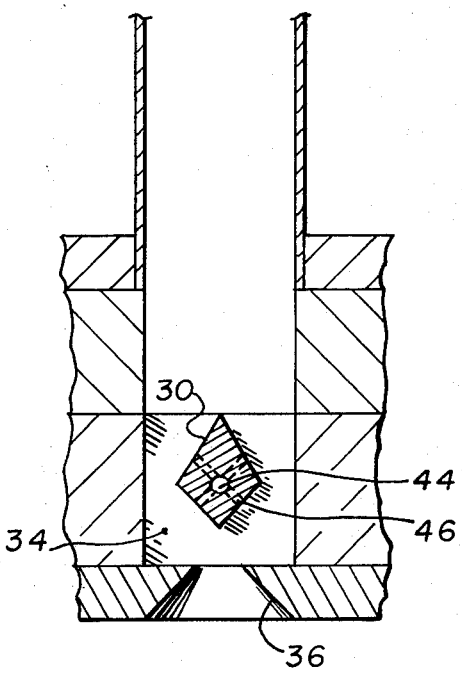
FIG. 4 is a cross-sectional picture of the mixing chamber of FIG. 3 taken along sight lines 4—4.
Figure 5:
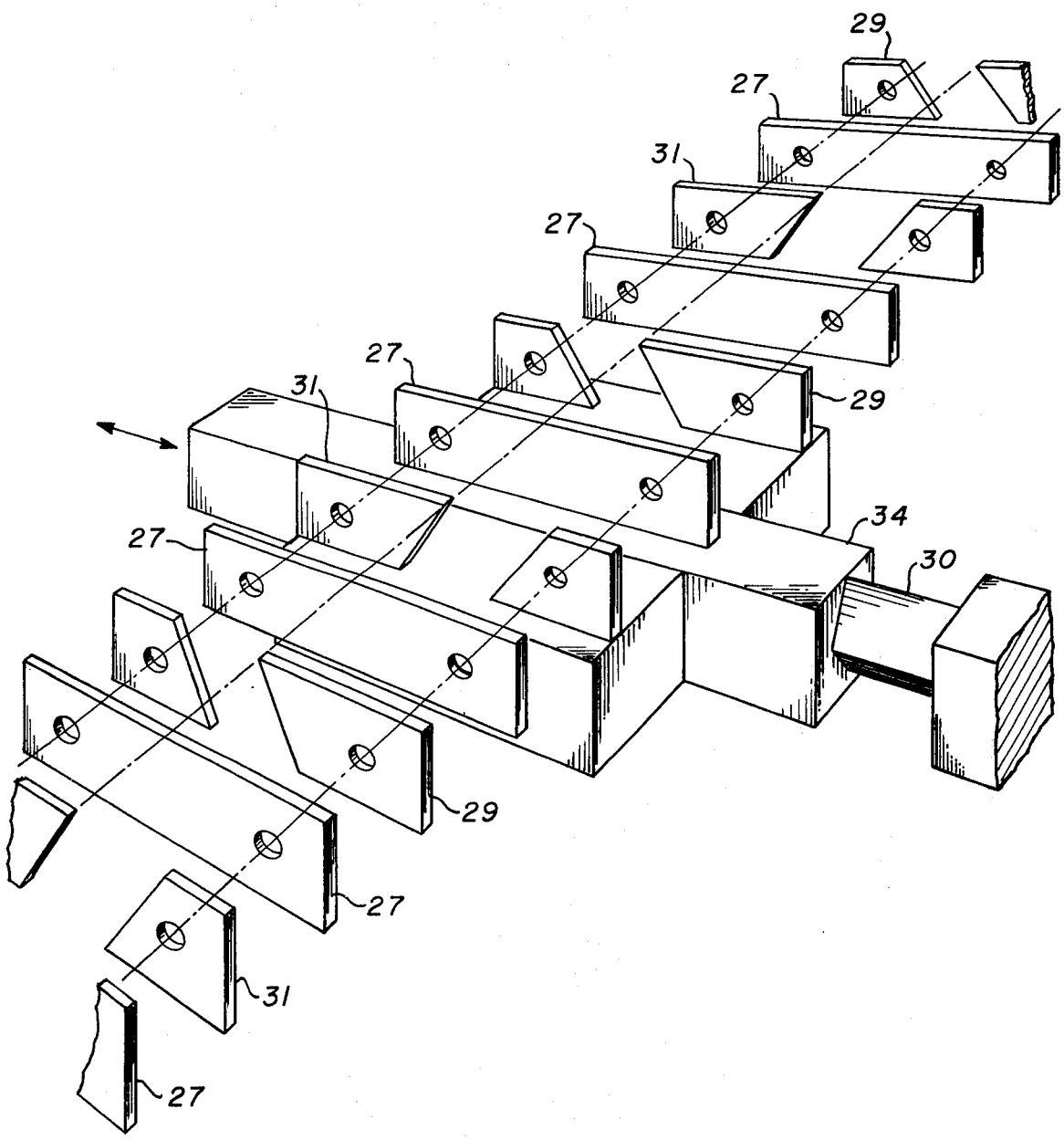
FIG. 5 is an exploded view of converging section 22 of FIG. 1 in position above shuttle 34, which is shown in perspective in its cleaning position.

The invention will now be further described with reference to the accompanying drawings. FIG. 1 illustrates a cross-sectional view of the apparatus suitable for carrying out the process of the invention. At the upper end of the apparatus is provided a premix storage hopper 16 separated into two chambers A and B by separating wall 18. A foundry sand/resin mixture and a foundry sand/catalyst mixture may comprise the two foundry materials to be contained by chambers A and B. At the lower end of the storage chambers is provided a converging section 22 composed of intermeshing delivery ducts 24 and 26. As shown in FIG. 5, the duct-forming members 29 form ducts 24, which conduct material from chamber A to mixing chamber 32, while duct-forming members 31 form ducts 26, which conduct material from chamber B. Through these ducts the respective materials in chambers A and B are introduced in alternating array into mixing chamber 32 through rectangular apertures 28 (see FIG. 2). Mixing chamber 32 is made up of a plurality of stationary surfaces and two opposite movable surfaces. Within the mixing chamber 32 is positioned a turbulence inducing baffle 30 (see FIG. 4 for cross-sectional detail) which interrupts the flow of sand by separating the sand flow into two parts with each part passing around opposite sides of the baffle 30. By separating and compressing the sand flow in its movement around the baffle 30 and by subsequently releasing the compression and inducing expansion, the alternating materials from chambers A and B are caused to be turbulently mixed within the chamber 32. Subsequent to this mixing, the mixed material passes through an outwardly diverging exit opening 36 for immediate delivery into a core or mold box 38.

The impetus required to force materials from chambers A and B through the mixing chamber 32 and into the core box 38 is provided by pressure administered to the foundry material contained in storage chamber 16 by means of pressurized air passing through valve 10 and air pressure lines 12. A movable cap plate 14 is positioned at the top of premix storage hopper 16 so that it may be clamped down in an air-tight connection on the top of premix storage hopper 16. The pressurized air from the air pipes 12 is introduced into the respective chambers A and B through holes in cap plate 14 thereby "blowing" the materials contained in chambers A and B through the converging ducts 24 and 26 and the mixing nozzle 20.

The turbulence inducing baffle 30 is held within the mixing chamber 32 in a fixed position between the two opposite movable surfaces which themselves are carried by movable shuttle member 34. This movable shuttle member 34 and the mixing nozzle 20 are adapted so that the shuttle member 34 may be moved through the mixing chamber 32 thereby moving one of the movable surfaces across the stationary surfaces. By so moving the shuttle member 34, mixing chamber 32 is swept of any residual mixed materials. Also by pushing the movable shuttle 34 through mixing chamber 32 parallel to the lengths of the rectangular apertures 28, the partitions 27 between alternating apertures 28 are cleaned off and the apertures 28 are then closed off by shuttle 34. The motion of the shuttle 34 along the length of the apertures 28 insures a good wiping and cleaning of the partitions 27 separating the apertures 28. The premix nozzle, generally indicated as 20, may be adapted in such a manner that upon motion of the movable shuttle member 34 the mixing baffle 30 is removed to a position outside of the mixing nozzle 20 to a cleaning position 40. At this position any residual mixed material that has been moved out of the mixing chamber by the movement of shuttle 34 may be discarded and any residual matter adhering to the shuttle 34 or the mixing baffle 30 may be immediately cleaned off by a cleaning means 42. Shuttle 34 may be left in a flow blocking position until the next blow operation, or it may be moved back to re-position baffle 30 in the mixing chamber 32 in preparation for the next blowing operation.

Figure 3:
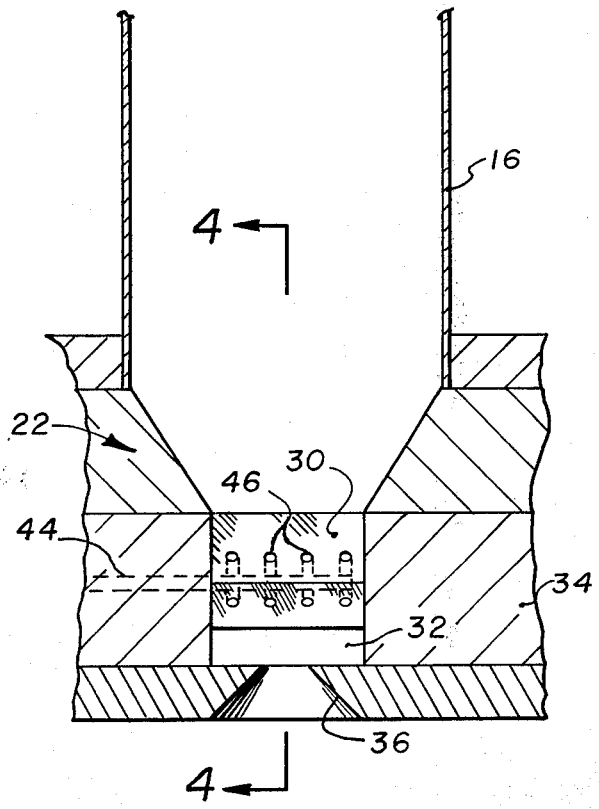
FIG. 3 is a sectional drawing of a kold box core making machine as shown in FIG. 1 but with an alternative resin/catalyst introduction arrangement.

An alternative arrangement is provided wherein premix storage hopper 16 consists of only one chamber (see FIG. 3). Storage chamber 16 may hold one material, sand, which has previously been mixed with either resin or catalyst. The sand mixture is delivered through a converging section, generally indicated by 22, into the mixing chamber 32 wherein the missing component, resin or catalyst, is introduced in close mixing relation with the turbulently flowing sand that is passing through the nozzle 20. In FIG. 3 one possible arrangement has been illustrated wherein the missing resin or catalyst is introduced into the mixing chamber 32 through a passage 14 located in the movable shuttle 34. Passage 44 may be adapted to deliver the missing element, catalyst or resin, into the mixing chamber through spraying orifices 46 in the turbulence inducing baffle 30 (see FIGS. 3 or 4). Another arrangement (not shown) would be to introduce the missing element, catalyst or resin, into the mixing chamber 32 by a spray or flow of the material from the side walls of the mixing chamber 32.

The operation of the apparatus is described as follows. The premix nozzle and premix storage hopper are swung to the side to receive loads of foundry sand mixed with resin and foundry sand mixed with catalyst in the respective chambers A and B. Subsequent to filling storage hopper 16, the apparatus is swung back into a blowing position. Movable cap plate 14 is then lowered into an air-sealing position thereby clamping off the top of storage hopper 16 and chambers A and B. Valve 10 is opened to introduce pressurized air through air pipes 12 into chambers A and B to force the sand/resin mixture and the sand/catalyst mixture through the converging section 22 into the mixing chamber 32. In the mixing chamber intermixing occurs and immediate discharge of the mixed sand/catalyst/resin is made to the core or mold box 38 where it cures to form the desired core or mold. Upon the termination of the blowing operation, the movable shuttle 34 is immediately moved through the mixing chamber 32 thereby sweeping and cleaning the mixing chamber 32 of any residual sand/catalyst/resin mixture. The immediate sweeping and cleaning of chamber 32 prevents mixed sand/resin/catalyst from adhering and accumulating in the interior of the mixing chamber. Without this clean-out feature, the accumulation would eventually prevent proper subsequent operation of the mixing nozzle and the blowing machine. The baffle 30 is also moved to a cleaning position and immediately cleaned.

In the prior art virtually all kinetic energy of the sand entering the mixing chamber was expended within the mixing chamber. It was therefore necessary to transfer the sand/resin/catalyst mixture to a blow tube. In a separate step the blowing tube was sealed off and new impetus was given to the sand for blowing into the mold by a second source of pressurized air applied to this separate blowing tube. Such is not the case in the present invention. During blowing, the mixing chamber of the disclosed invention is always essentially full of sand. The sand being blown into the chamber continually pushes the sand already in the chamber through the chamber's exit with sufficient force to accomplish direct and immediate blowing of the core. Therefore, the need for a separate blowing tube is eliminated. Also in the prior art any accumulation that occurs in the separate blowing chamber or in the mixing nozzle itself necessitates swinging the machine out of blowing position for cleaning. In the present invention the slide-through shuttle enables complete cleaning while the blowing machine remains in its blowing position. An additioanl feature which reduces machine recycle time is that the premix storage hopper can be of sufficient volume to blow more than one core without requiring the interruption of swinging the machine aside and refilling the hopper. One feature of the present invention, unlike the prior art, is that there is no need to carefully premeasure the charges of sand since the blowing operation can be terminated when the core is full by removing the air pressure on the sand or by simply sliding the shuttle through the mixing chamber and into a flow blocking position. When the blowing machine has been "shut off" in this manner, no residual sand/catalyst/resin mixture remains within the machine which can cure and cause subsequent obstruction.

It will be understood that the embodiment shown and described herein is merely illustrative and that changes may be made without departing from the scope of the invention as claimed.

What is claimed is:

1. A premix nozzle for kold box process comprising:

a. a mixing chamber formed by a plurality of stationary surfaces and a pair of opposite movable surfaces;

b. introduction means for introducing sand, resin and catalyst in close mixing relation into said mixing chamber;

c. an exit opening leading from said mixing chamber;

d. means for sweeping said stationary surfaces of said mixing chamber clear of residual sand by movement of one of said movable surfaces across each of said stationary surfaces; and e. a baffle affixed to and carried between said movable surfaces, which baffle, when positioned in said chamber, induces a mixing turbulence in the flow of said sand while flowing through said chamber.

2. A premix nozzle for cold box process as recited in claim 1 wherein, said introduction means including:

a. a first multiplicity of inlet ducts for admitting a mixture of sand and resin into said mixing chamber; and b. a second multiplicity of inlet ducts arranged in alternating relationship with said first multiplicity of inlet ducts for admitting a mixture of sand and catalyst into said mixing chamber.

3. A premix nozzle for cold box process, as recited in claim 2, wherein said inlet ducts are rectangular and said movable sweeping means moves in the direction of the long axis of said rectangular inlet ducts.

4. A premix nozzle for kold box process as recited in claim 1 wherein said means for sweeping said stationary surfaces and said baffle may be moved to a position external to said chamber and nozzle for cleaning.

5. A premix nozzle for kold box process as recited in claim 1 wherein said means for sweeping said stationary surfaces is a reciprocating shuttle.

6. A premix nozzle for kold box process, comprising:

a. a mixing chamber formed by a plurality of stationary surfaces and a pair of opposite movable surfaces;

b. an inlet duct for admitting a flow of foundry sand containing a predetermined amount of resin into said mixing chamber;

c. means for sweeping said stationary surfaces of said mixing chamber of residual sand by movement of one of said movable surfaces across each of said stationary surfaces;

d. a baffle affixed to and carried between said movable surfaces, which baffle, when positioned in said chamber, induces a mixing turbulence in the flow of said sand while flowing through said chamber;

e. means within said mixing chamber for introducing a predetermined amount of catalyst into said mixing chamber in close mixing relation with said turbulently flowing sand; and f. an exit opening leading out of said mixing chamber.

7. A premix nozzle for cold box process as recited in claim 6 wherein, said baffle is adapted to introduce a predetermined amount of catalyst into the turbulent flow of said sand thereby constituting said catalyst introduction means.

8. A premix nozzle for kold box process, comprising:

a. a mixing chamber formed by a plurality of stationary surfaces and a pair of opposite movable surfaces;

b. an inlet duct for admitting a flow of foundry sand containing a predetermined amount of catalyst into said mixing chamber;

c. means for sweeping said stationary surfaces of said mixing chamber of residual sand by movement of one of said movable surfaces across each of said stationary surfaces;

d. a baffle affixed to and carried between said movable surfaces, which baffle, when positioned in said chamber, induces a mixing turbulence in the flow of said sand while flowing through said chamber;

e. means within said mixing chamber for introducing a predetermined amount of resin into said mixing chamber in close mixing relation with said turbulently flowing sand; and f. an exit opening leading out of said mixing chamber.

9. A premix nozzle for kold box process as recited in claim 8 wherein, said baffle is adapted to introduce a predetermined amount of resin into the turbulent flow of said sand thereby constituting said resin introduction means.

* * * * *